US007903058B1

(12) United States Patent
Jacquet et al.

(10) Patent No.: US 7,903,058 B1
(45) Date of Patent: Mar. 8, 2011

(54) FORWARD LED VOLTAGE MONITORING FOR OPTIMIZING ENERGY EFFICIENT OPERATION OF AN LED DRIVER CIRCUIT

(75) Inventors: Florence Jacquet, Penn Valley, CA (US); William J. McIntyre, Wheatland, CA (US); Damian Swank, Rocklin, CA (US); Nathanael Griesert, Grass Valley, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 1293 days.

(21) Appl. No.: 11/041,429

(22) Filed: Jan. 21, 2005

(51) Int. Cl.
*G09G 5/00* (2006.01)

(52) U.S. Cl. ..... 345/82; 345/86; 345/207

(58) Field of Classification Search ..... 345/82, 345/86, 207
See application file for complete search history.

(56) References Cited

U.S. PATENT DOCUMENTS

| | | | | |
|---|---|---|---|---|
| 6,897,709 | B2 * | 5/2005 | Henry | 327/536 |
| 7,489,292 | B2 * | 2/2009 | Kasai | 345/76 |
| 2003/0169097 | A1 * | 9/2003 | Henry | 327/536 |
| 2004/0080361 | A1 * | 4/2004 | Henry | 327/536 |
| 2005/0017702 | A1 * | 1/2005 | Kernahan et al. | 323/282 |
| 2006/0033442 | A1 * | 2/2006 | D'Angelo | 315/86 |
| 2006/0109205 | A1 * | 5/2006 | Deng | 345/46 |
| 2006/0279562 | A1 * | 12/2006 | Emek et al. | 345/207 |
| 2007/0008255 | A1 * | 1/2007 | Emek et al. | 345/82 |

OTHER PUBLICATIONS

Maxim, "MAX1570 White LED Current Regulator with 1x/1.5x High-Efficiency Charge Pump," Jul. 2000.
Semtech, "SC604 Low Noise, High Efficiency Regulated White LED Driver," Revised Aug. 15, 2002.

* cited by examiner

*Primary Examiner* — Bipin Shalwala
*Assistant Examiner* — Afroza Y Chowdhury

(57) ABSTRACT

A circuit and method for monitoring the forward voltage for a plurality of LEDs in a battery powered device so that the gain in the LED driver circuit can be switched at a point that optimizes the energy provided by the battery. The invention provides for sensing each LED's voltage, $V_{LED}$, and determining the maximum forward voltage, $V_{LEDmax}$, between the plurality of LEDs. The invention uses the knowledge of $V_{LEDmax}$ in conjunction with $V_{IN}$, converter output resistance and LED current, and current source/sink minimum headroom to switch from an initial gain to some higher gain just before the current sinks/sources would drop out, or from a higher gain to a lower gain in the event of the battery voltage going back to a voltage close to its initial value after being momentarily pulled down by a heavy load.

25 Claims, 7 Drawing Sheets

FORWARD LED VOLTAGE MONITORING FOR OPTIMIZING ENERGY EFFICIENT OPERATION OF AN LED DRIVER CIRCUIT

FIELD OF THE INVENTION

The present invention relates to driver circuits and more specifically to an apparatus and method for monitoring forward LED voltages to enable optimal energy efficiency in LED driver circuits.

BACKGROUND

Portable battery power devices are increasingly common in modern life, e.g., mobile telephones, MP3 players, personal digital assistants (PDAs), notebook computers, DVD players, CD players, radios, televisions, and the like. However, the relatively short span of time before a fully charged battery becomes discharged and needs to be either recharged or replaced is a common problem in the operation of most battery powered devices To extend the "lifetime" of a battery's effective use, energy efficient circuitry is often included in battery powered devices.

Many battery powered devices include displays that provide information regarding the operation of the devices. Often, these displays are backlit to enable their use in low light environments. However, since backlit displays can consume a relatively large percentage of the available energy in the battery, relatively efficient LED driver solutions are preferred.

In the past, current regulated switch capacitor LED drivers have been employed to achieve a relatively optimized energy efficiency by switching between different gains. These different gains are switched to follow the voltage drop across the battery as it discharges. For example, when the battery is fully charged a gain of 1 is often selected because the battery's voltage is high enough to efficiently drive the LEDs. However, as the battery discharges and its voltage drops, a gain greater than 1 is then selected (1.5X for example) to boost the output of the LED driver above the battery's voltage. Previously, it has been difficult to determine the optimal point for this gain transition. Thus, it is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION

The present invention is described fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment or an embodiment combining software and hardware aspects. The following detailed description is, therefore, not to be taken in a limiting sense.

Briefly stated, the present invention is directed to an apparatus and method for monitoring the forward voltage for a plurality of LEDs in a battery powered device so that the gain in the LED driver circuit can be switched at a point that optimizes the energy provided by the battery to illuminate the LEDs. The invention provides for sensing each LED's voltage, $V_{LED}$, and determining the maximum forward voltage, $V_{LEDmax}$, between the plurality of LEDs. The invention uses the knowledge of $V_{LEDmax}$ in conjunction with $V_{IN}$, converter output resistance and LED current, and current source/sink minimum headroom to switch from an initial gain to some final gain (higher than initial gain) just before the current sinks/sources would drop out. Similarly, the invention provides for switching from the higher gain back to the initial gain in the event that the battery voltage rises back to its initial voltage after being momentarily pulled down by a heavy load or other factors.

In part, because of differences in the gain selection circuitry when implemented for a high side LED driver versus a low side LED driver, the invention provides for two complementary embodiments that enable gain selection on the high side and low side. The conditions for gain switching that account for the above mentioned factors are developed in the implementation section below.

As discussed above, after discharging for some period of time, the battery's voltage drops. For example, the cell voltage of a lithium ion battery (typical battery for mobile phones) usually ranges from 4.2 Volts at full charge down to 2.5 Volts at deep discharge. Since this lower voltage is often less than the desired power supply voltage for a battery powered device, a boost converter is employed to extend the period of time that the battery can be a useful energy source for the device.

Figure 1:
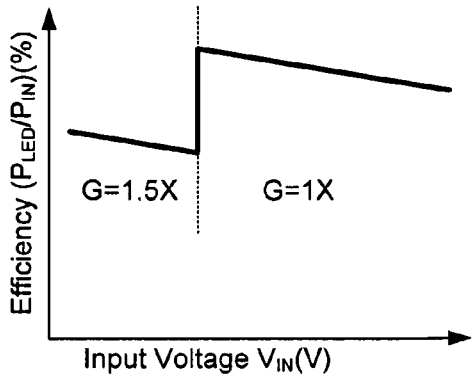
FIG. 1 illustrates the change in efficiency in regard to the input Voltage ($V_{IN}$) and different gains provided by the LED driver circuit.

FIG. 1 illustrates the change in efficiency in regard to the input Voltage ($V_{IN}$) and different gains provided by the LED driver circuit. As shown, a gain of 1.5X is provided for a relatively low $V_{IN}$ and a gain of unity (one) for higher $V_{IN}$.

Figure 2:
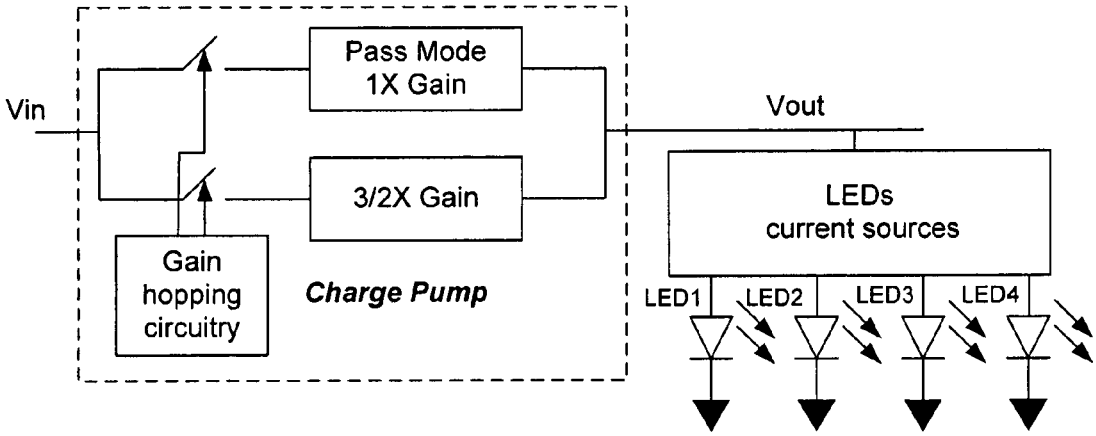
FIG. 2 schematically illustrates an exemplary high side LED driver.

Although the invention can be implemented with both high side and low side LED drivers, FIG. 2 illustrates an exemplary high side LED driver.

Figure 3:
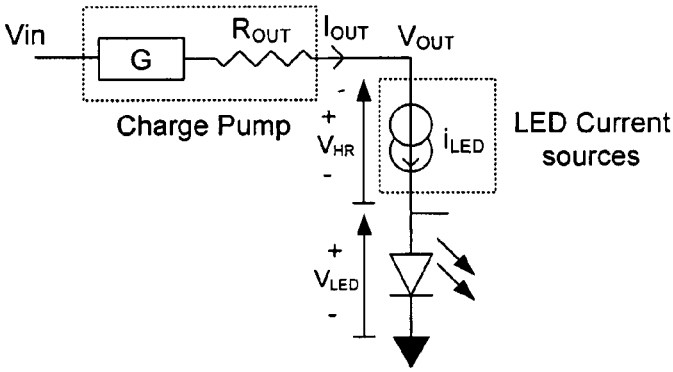
FIG. 3 schematically illustrates a high side LED driver.

Additionally, as shown in FIG. 3, in an ideal case, the Gain G is unity and so $V_{OUT}=V_{IN}$. In a non-ideal case, $V_{OUT}=V_{IN}-R_{OUT}*I_{OUT}$, with $R_{OUT}$ defined as the charge pump open loop output resistance and $I_{OUT}$ the output current as shown in FIG. 3. Also, $I_{OUT}=N.I_{LED}$ with N equivalent to the number of LEDs (N=4 in FIG. 2).

The efficiency of the LED driver depends on the gain that the LED driver is operating in:

$$n \equiv \frac{P_{OUT}}{P_{IN}} = \frac{NV_{LED} * I_{LED}}{V_{IN} * I_{IN}} \cong \frac{NV_{LED} * I_{LED}}{V_{IN} * (G * I_{OUT} + I_Q)} \quad \text{Equation 1}$$

The quiescent current $I_Q$ is negligible for moderate to high output current applications. This equation highlights that the efficiency is optimal when the LED driver operates in the lowest possible gain that can still provide a $V_{OUT}$ voltage to enable the operation of the battery powered electronic device.

For the case where the LED driver is operating with a gain of one, the following second equation applies:

$$I_{OUT} = I_{IN} \text{ and } \eta \cong \frac{V_{LED}}{V_{IN}} \quad \text{Equation 2}$$

For the case where the LED driver is operating with a 1.5 times gain (1.5X boost mode), the following third equation applies:

$$I_{IN} = 1.5 * I_{OUT} \text{ and } \eta \cong \frac{V_{LED}}{1.5 * V_{IN}} \quad \text{Equation 3}$$

The LED current sources that are connected between $V_{OUT}$ and the diodes need enough headroom, $V_{HR}$, across them to provide the desired current in the LED. The headroom is the voltage across each current source $V_{HR}=V_{OUT}-V_{LED}$. The current sources require a sufficient amount of headroom voltage to be present across them in order to regulate properly. The minimum headroom voltage $V_{HRmin}$ is proportional to the current flowing through the current source as described by the equation: $V_{HRmin}=R_{HR}*I_{LED}$, then $R_{HR}$ represents the ON resistance of the current source.

For LED drivers, the optimal efficiency is achieved by switching gains based on the value of $V_{IN}$ and the forward LED voltage $V_{LED}$ as Equations 2 and 3 highlight it. This optimal efficiency can be achieved by enabling its DC-DC converter to stay in a gain of one (unity) over the largest input voltage range possible, while at the same time preventing the headroom of the current sources from dropping below $V_{HRmin}$. The input voltage at which the converter switches gains depends on the forward voltage of the LEDs that are being driven.

The invention provides for initially sensing each LED voltage, $V_{LED}$, and determining the maximum forward voltage, $V_{LEDmax}$, between several LEDs. The invention employs the knowledge of $V_{LEDmax}$ in conjunction with what is known about $V_{IN}$, converter output resistance and LED current, and current source/sink minimum headroom to switch from an initial gain to some higher gain just before the current sinks/sources drop out or from a higher gain to a lower gain in the event of the battery voltage going back to its initial value after being momentarily pulled down by a heavy load.

The conditions for gain switching that account for the above mentioned factors are developed in the implementation section below. Because of the uniqueness of the gain selection circuitry when implemented for a high side LED drive solution versus a low side LED drive solution, there are two subsections in the implementation. The first subsection describes the circuitry used for gain selection in a high side drive system and the second describes circuitry used for gain selection in a low side drive system.

Implementation of Gain Selectors for High Side and Low side Drivers

(1) HIGH SIDE SELECTOR AND FORWARD VOLTAGE MONITOR CIRCUITRY

Figure 4:
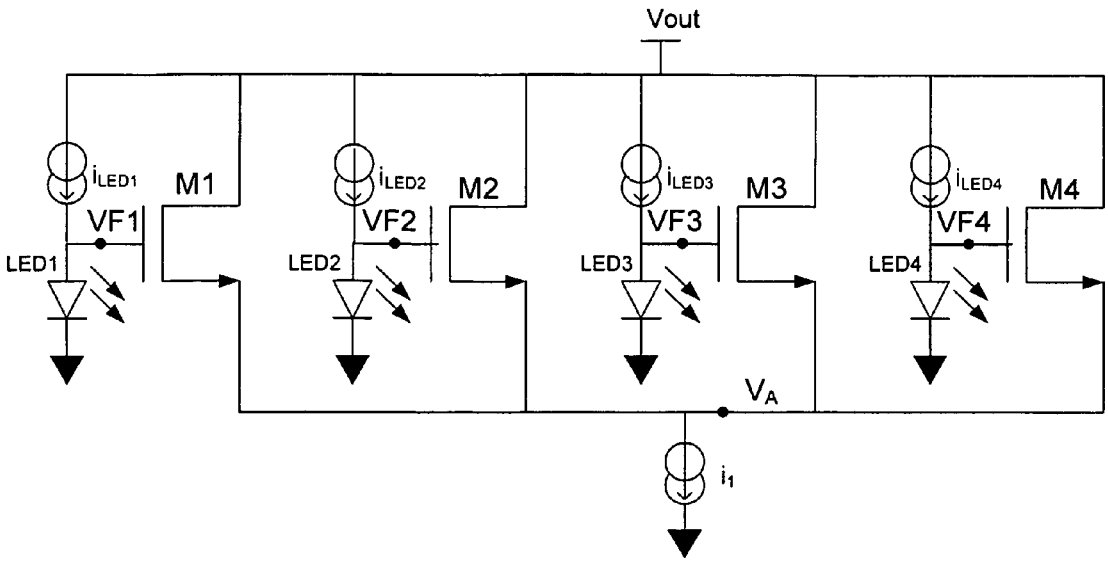
FIG. 4 schematically illustrates a MOS maximum selector circuit implementation.

The forward voltage of different LEDs driven by the same amount of current may vary considerably. As shown in FIG. 4, a circuit based on source followers in parallel can be used to determine the maximum forward LED voltage of several LED ($V_{LEDmax}$).

The LED with the largest forward voltage forces a larger gate voltage onto the NMOS which is sampling the LED voltage. The NMOS with the maximum gate drive tends to take most of the current $i_1$ and the voltage at its gate appears at its source minus its Vgs as illustrated in the fourth equation:

$$V_A=V_{LEDmax}-\text{Vgs} \quad \text{Equation 4}$$

The maximum LED forward voltage is hence measured. Although this example is based on 4 LEDS, the invention can be implemented for any greater or lesser number of LEDs.

As shown in FIG. 4, if VF1=VF2=VF3=VF4, each NMOS will have the same amount of current: $i_1/4$. The Vgs of all of the NMOS will be less than in the case when one is dominating the others as illustrated by the fifth equation as follows:

$$Vgs = Vt + \sqrt{\frac{Id.2.L}{W.\mu_o C_{ox}}} \quad \text{Equation 5}$$

Figure 5:
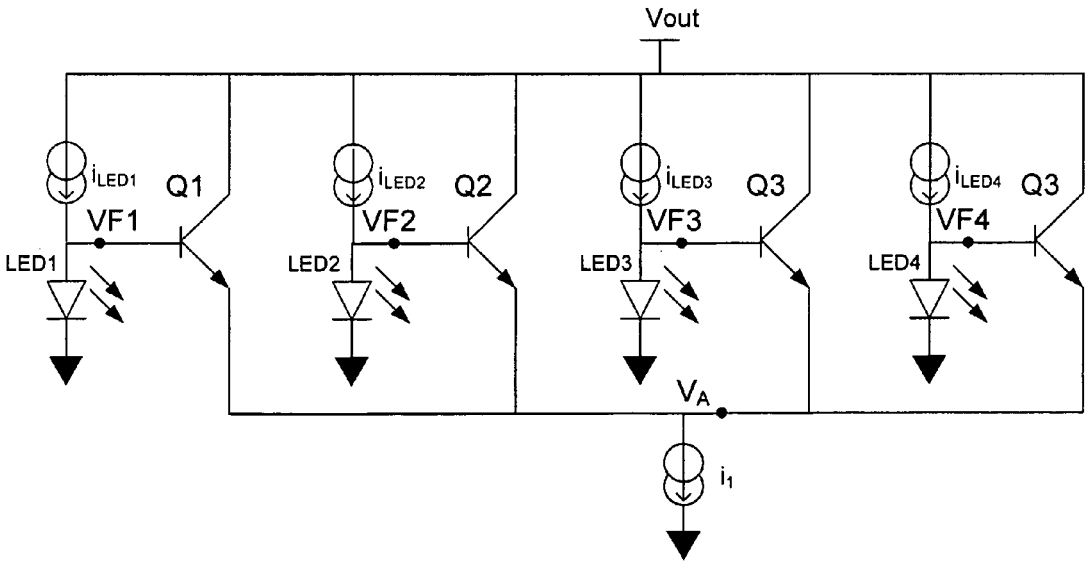
FIG. 5 schematically illustrates a bipolar maximum selector implementation.

Additionally, NPN transistors can be used instead of MOS transistors to reduce the impact of current density differences. In the case of a bipolar transistor, equation 4 is modified as follows: $V_A=V_{LEDmax}-\text{Vbe}$ Equation 4b One embodiment, of a final high side maximum forward LED voltage selector circuit is shown in FIG. 5.

Gain Transitions

To improve efficiency, a gain of unity (one) is selected instead of 3/2 if $V_{IN}$ is high enough. For example, if Vin is greater than the required headroom across the current sources, the drop across the charge pump and the maximum LED voltage, then Vin can be passed to Vout. In one embodiment, to avoid gain chattering, a hysteresis voltage $V_{hys}$ is added when switching gain from 3/2 to 1.

The equations for further implementing the invention are as follows:

$$G=1 \text{ if } \text{Vin}>V_{hr}+V_{LEDmax}+\text{Rout}_{1X}*\text{Iout}+V_{hys} \quad \text{Equation 6}$$

$$G=3/2 \text{ if } \text{Vin}<V_{hr}+V_{LEDmax}+\text{Rout}_{1X}*\text{Iout} \quad \text{Equation 7}$$

Equation 6 can be reworked as:

$$G=1 \text{ if } V_{LED\ max}<V_{IN}-V_{HR}-\text{Rout}_{1X}*I_{OUT}-V_{hys} \quad \text{Equation 8}$$

In this case, the gain selection is based on a comparison between a headroom replica circuit that models the right part of the equation 8 and $V_{LEDmax}$. The headroom replica circuit is yet another exemplary embodiment of the maximum selector circuit. Also, since the determination of VLEDmax introduces Vbe (or Vgs)—see equation 4b above—the headroom replica circuit also uses a source follower:

$$G=1 \text{ if } V_{LEDmax}-\text{Vbe}>V_{IN}-V_{HR}-\text{Rout}_{1X}*I_{OUT}-V_{hys}-\text{Vbe} \quad \text{Equation 9}$$

An exemplary schematic that implements equation 9 is shown in FIG. 6. The left part of equation 9 is connected to the negative input of the comparator, the right part of the equation to the positive input of the comparator.

Figure 6A:
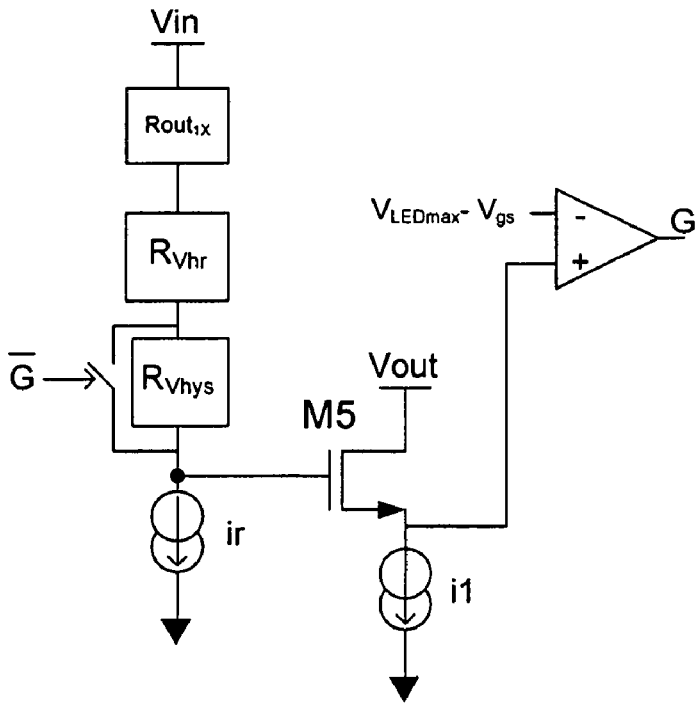
FIG. 6A schematically illustrates a headroom replica implementation.

As shown in FIG. 6A, the current it can be either fixed and representing the worst case or proportional to the current in the LED to achieve better efficiency at lower LED currents. Efforts are made to have the replica impedances track the real $\text{Rout}_{ix}$, $R_{Vhr}$ and $R_{Vhys}$ over temperature and supply. However, since no replica can be perfect, additional error correction can be built into each small replica block.

Switching too early into a gain of 1 due to a too small headroom replica could be a real issue for the LED: the charge pump would not be able to deliver the right current Iout and the LED light would be dimmed. Also, changes in headroom voltage from one current source to the next, which is possible with LED forward voltage mismatch can result in different output currents and LED brightness mismatch. However, if too much error compensation is added, it can negatively impact efficiency by causing switching between gains to occur too late.

Figure 6B:
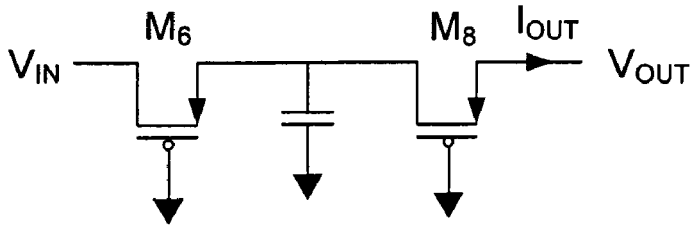
FIG. 6B schematically illustrates simplified model of the switch array of the charge pump in unity gain.
Figure 6C:
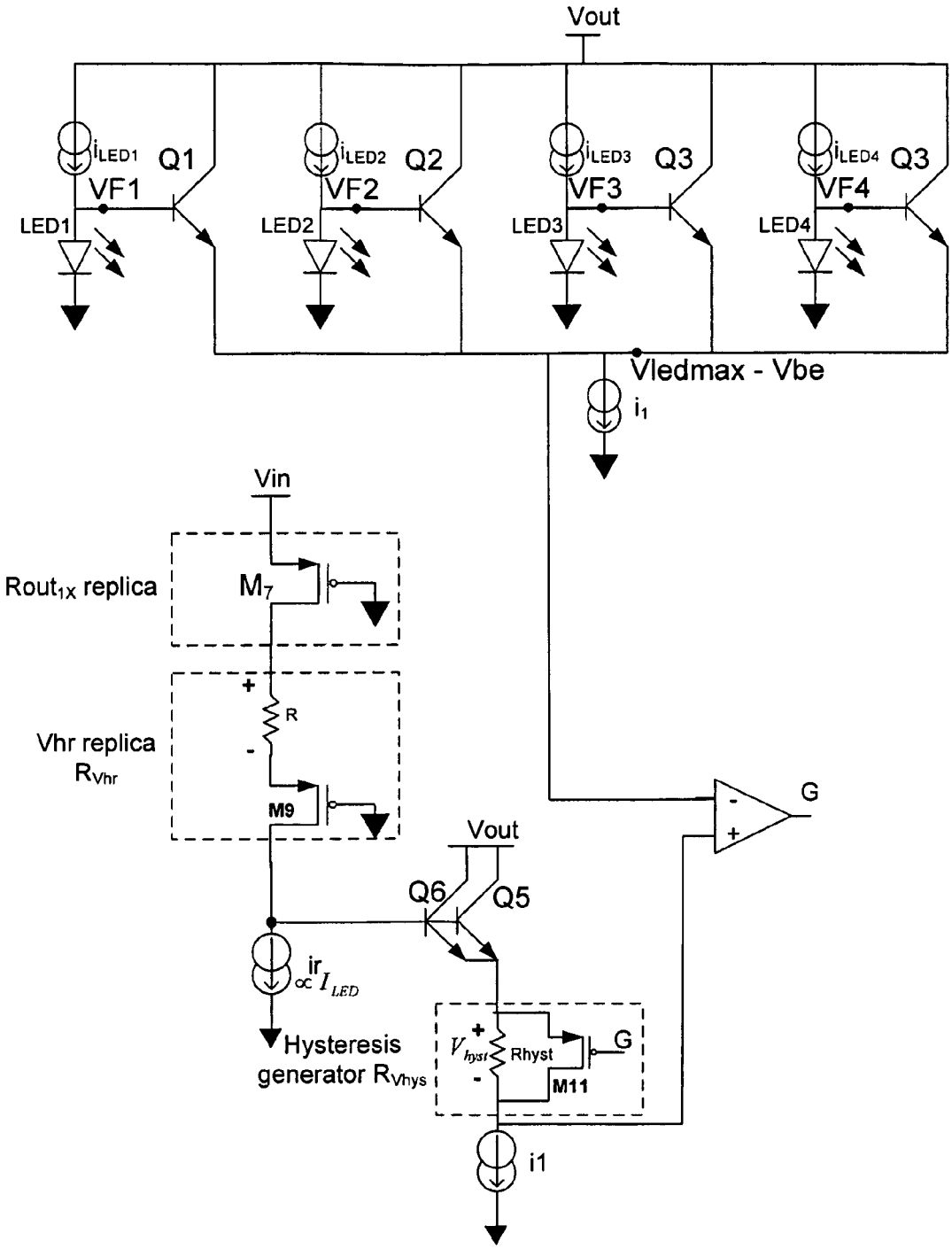
FIG. 6C schematically illustrates a device level gain select implementation for a high side driver circuit.

To model the charge pump output impedance in gain of 1, $\text{Rout}_{1X}$, a small PMOS M7 is chosen in FIG. 6C and the ratio of M7 to the switch array PMOS M6 and M8 of FIG. 6B is substantially the same as the ratio chosen for Ir to the total output current $N*I_{LED}$.

For this case, the ratio selected is 1:1000 as shown below:

$$ir \approx \frac{N*i_{LED}}{1000} \text{ and } W_{M7} \propto \frac{W_{M6}}{1000}$$

FIG. 6B illustrates one embodiment of an exemplary headroom replica circuit.

Referring to FIG. 6C, the device level gain select implementation in High Side LED driver system is presented. The first block called $\text{Rout}_{1X}$ replica fed by it generates a voltage across a fully driven PMOS M7 that replicates the voltage drop in one possible implementation of a gain of 1 which is a PMOS pass transistor from $V_{IN}$ to $V_{OUT}$. The headroom replica is in this example made of a PFET M9 and a resistor R that replicates the current sources regulating current in the LEDs. That sub block generates a voltage that will track the dropout voltage of a current source driver made of a PMOS mirror with source degeneration. Devices Q5 and Q6 are used as balancing level shifters: they match the level shift generated by the minimum selector made of $Q_1$-$Q_4$. The hysteresis generated by Rhys and i1 is a fixed voltage that is added or taken out by PMOS switch M11. A voltage mode comparison is hence used for the high side gain selector.

(2) LOW SIDE SELECTOR AND FORWARD VOLTAGE MONITOR CIRCUITRY

Figure 7:
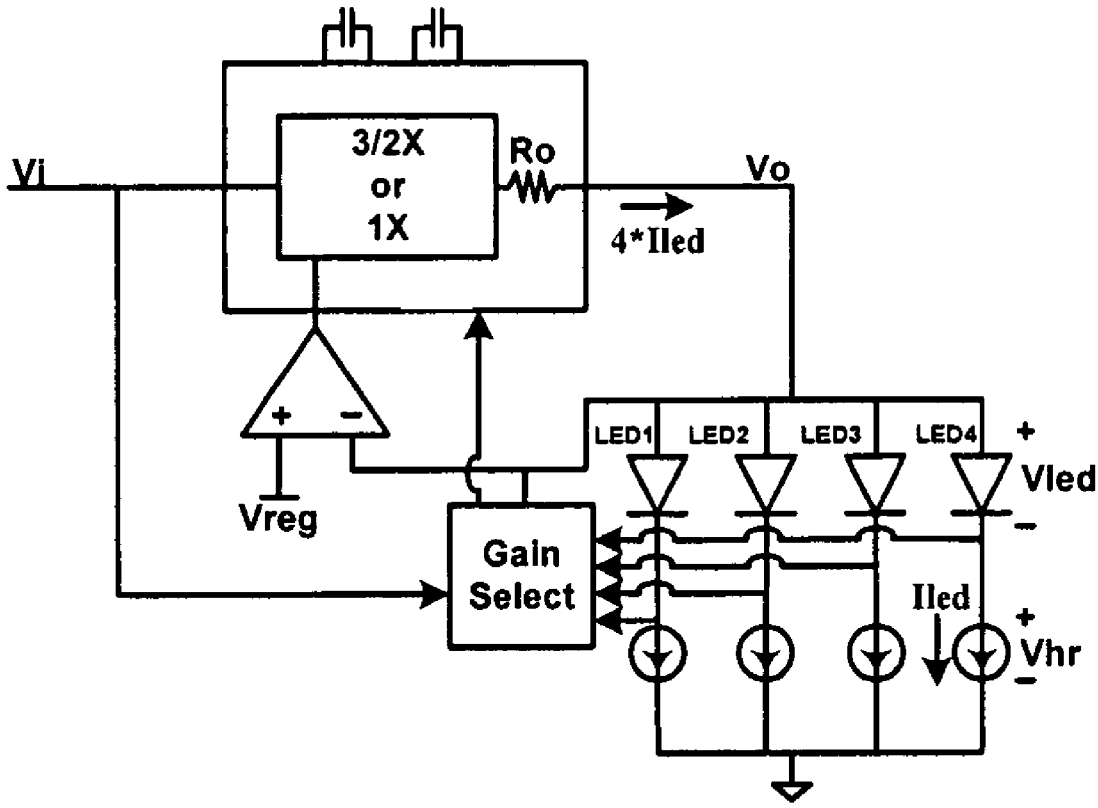
FIG. 7 schematically illustrates a low side driver system.

FIG. 7 shows an exemplary LED driver utilizing low side current sinks. The LED forward voltage sensing and gain selecting circuitry described in this section are designed for application in the example system shown in FIG. 7 that has four LEDs. However, this circuitry can be modified to operate correctly in an "N" LED driver topology, and the charge pump configuration need not be identical to that shown in FIG. 7 for the gain selection circuit to be useful.

FIG. 7 provides the context in which the implemented gain select circuitry operates. Each of the LED anodes are connected to the output of the charge pump, Vo, that is regulated to a value of $V_{REG}$ if the charge pump has sufficient headroom. The inputs to the gain select circuit are the input voltage Vi, the LED supply voltage Vo, and the voltage across each of the current sinks $V_{HR}$. The gain select circuit uses each of these inputs to select the gain transition voltage for optimum efficiency.

Figure 8:
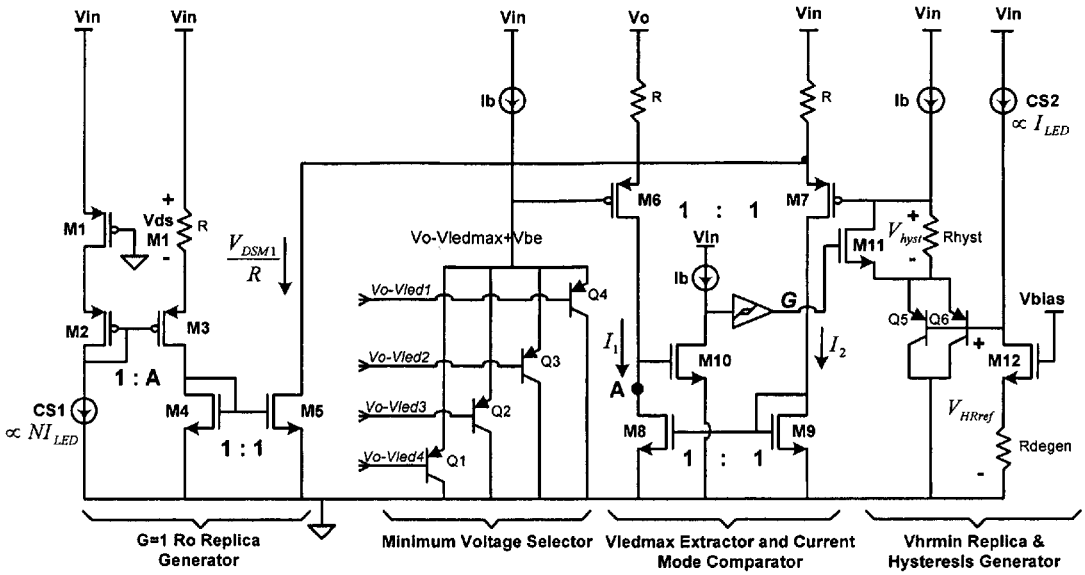
FIG. 8 schematically illustrates a device level gain select implementation for a low side driver circuit.

FIG. 8 shows a device level implementation of the gain select circuit used in a low side LED driver system. This circuit is described by partitioning functionality into four separate subcircuits that are shown and labeled in FIG. 8. The gain selection criteria for the low side driver is as follows:

The charge pump should switch from gain of 1 to 3/2 as $V_{in}$ falls below:

$$V_{in_{1x\to 3/2X}}=V_{LEDmax}+\text{NI}_{LED}R_O+V_{HRmin} \quad \text{(Equation 10)}$$

The charge pump should switch from gain of 3/2 to 1 as $V_{in}$ rises above:

$$V_{in_{3/2X\to 1X}}=V_{LEDmax}+\text{NI}_{LED}R_0+V_{HRmin}+M_{hyst} \quad \text{(Equation 11)}$$

Where $V_{hyst}$ is a hysteresis voltage needed so that gain chattering does not occur.

While a voltage mode type comparison can be used for the high side gain selector because a level shifted $V_{LEDmax}$ (relative to ground) can be directly measured using the maximum voltage selector circuit shown in FIGS. 4 and 5, a current mode approach is employed for the low side gain selector to extract the $V_{LEDmax}$ information from the set of LEDs.

Referring to FIG. 8, the voltage present across each of the current sinks (shown in FIG. 7) is routed into the minimum voltage selector circuit composed of Q1-Q4 and a current source. The signal at the gate of M6 depends on the voltages $V_{LEDmax}$ and $V_O$. By buffering and level shifting the output of the minimum selector circuit to the bottom side of a resistor connected to $V_O$, a current $I_1$ is generated that will vary only with $V_{LEDmax}$, Vbe, and Vsg. Therefore $V_O$-$V_{LEDmax}$+Vbe is measured using the minimum selector circuit and the voltage $V_O$-($V_O$-$V_{LEDmax}$+Vbe+Vsg)=$V_{LEDmax}$−Vbe-Vsg is placed across a resistor with the value R.

The right most subcircuit in FIG. 8 is designed to generate a minimum headroom voltage reference that replicates the current sinks regulating current in the LEDs. In this example, $R_{degen}$, $M_{12}$, and CS2 are used to generate a voltage that will track the drop out voltage of a current sink driver made of an NMOS mirror with source degeneration. Note that CS2 sources a current that is proportional to $I_{LED}$, so that the reference headroom tracks the needed headroom of the actual current sink. Devices $Q_5$ and $Q_6$ are used as balancing level shifters (they match the level shift generated by the minimum selector made of $Q_1$-$Q_4$), and the resistor $R_{hyst}$ in conjunction with current source Ib generate a hysteresis voltage that is added in or taken out by NMOS switch M11. Device M7 level shifts the headroom reference and hysteresis voltage to the bottom side of a resistor connected to $V_{in}$, placing a voltage equal to $V_{in}$-($V_{Href}$+$V_{hyst}$+Vsg+Vbe) across a resistor with a value R.

The left most circuit composed of $M_1$-$M_5$, R, and CS1 is used to generate and route a current that is proportional to the voltage across a fully driven PMOS device that replicates the voltage drop in one possible implementation of a gain of one, which is a PMOS pass transistor from $V_{in}$ to $V_O$. Again, the current sink CS1 pulls a current that is proportional to the current being supplied by the charge pump so that the gain select circuit optimizes efficiency over LED current as well as input voltage. Care is taken to size $M_2$ and $M_3$ so that A is equal to the current density ratio between the devices.

Finally, the current mode comparator resolves the comparison between currents $I_1$ and $I_2$.

If $I_2>I_1$ then G=1 (high state=gain of 1 selected) or:

$$\frac{V_{in}-(V_{HRref}+V_{hyst}+V_{SG}+V_{BE})-\frac{V_{DSM1}}{R}R}{R}>\frac{V_O-(V_O-V_{LEDmax}+V_{SG}+V_{BE})}{R} \quad \text{(Equation 12)}$$

or after appropriate regrouping and cancellation of terms:

$$G=1 \text{ when: } V_{in}>V_{LEDmax}+V_{HRref}+V_{hyst}+V_{DSM1} \quad \text{(Equation 13)}$$

And, $$G=0 \text{ when: } V_{in}<V_{LEDmax}+V_{HRref}+V_{DSM1} \quad \text{(Equation 14)}$$

The exemplary circuit as shown in FIG. 8 implements the desired gain selection criteria for the low side LED driver.

Figure 9:
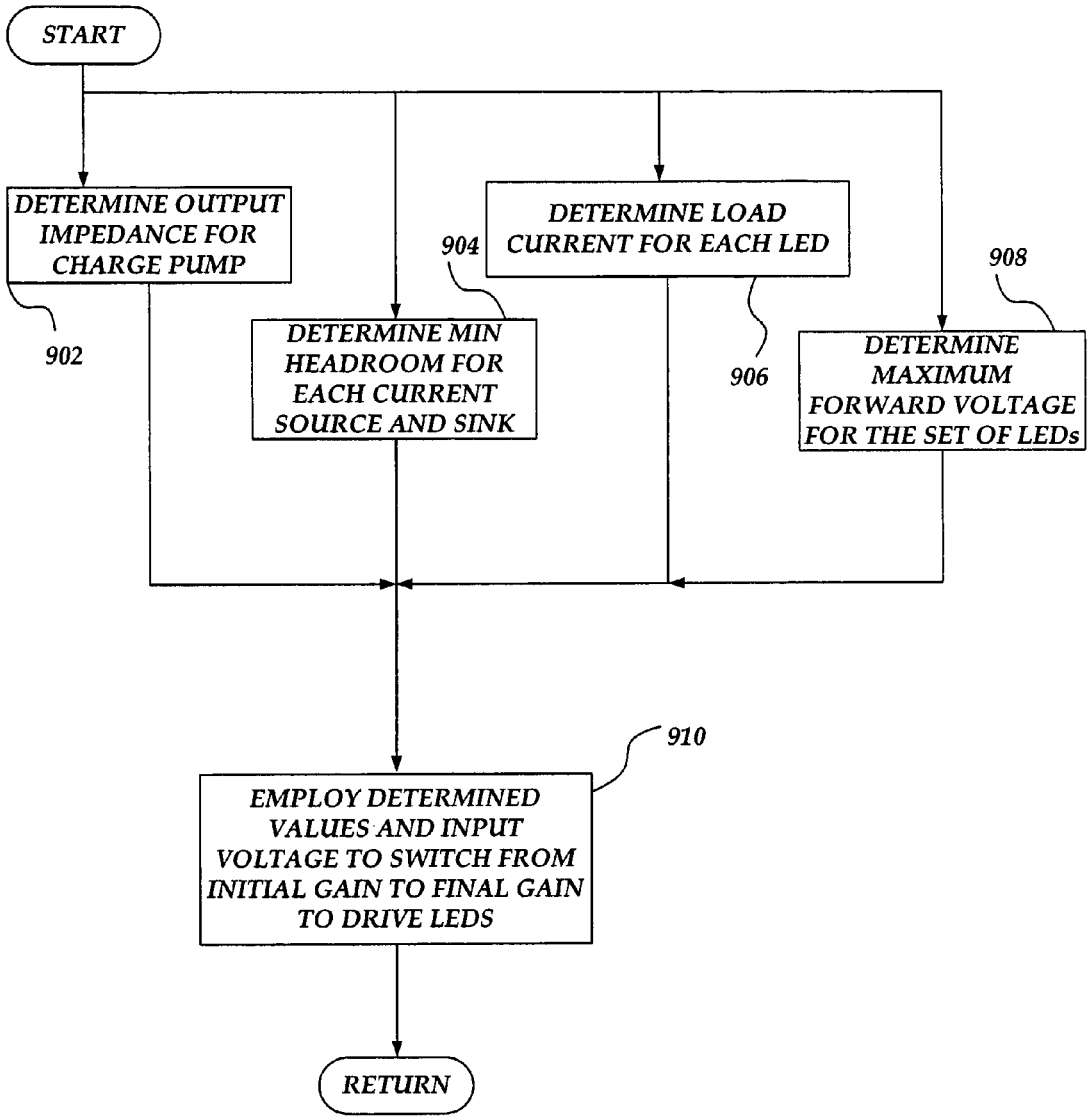
FIG. 9 shows a flow chart for a process in accordance with the invention.

FIG. 9 illustrates a block diagram of a method for determining a switching point of the gain of circuit to drive a plurality of LEDs. Moving from a start block, the process performs actions at four blocks in parallel, i.e., block 902, block 904, block 906, and block 908. At block 902, the output impedance of a charge pump is determined. Also, at block 904, the min headroom for each current source and each current sink is determined. Further, at block 906, a modeled determination of the load current to drive each of the LEDs is performed. Additionally, at block 908, the forward maximum voltage for each of the LEDs is determined.

Next, the process advances to block 910 where these determined values and the input voltage are employed to switch from an initial gain to a final gain to drive the plurality of LEDS. The determined switching point enables the plurality of LEDs to be driven in an optimally energy efficient manner. Further, the process steps to a return block and returns to performing other actions. Additionally, although the actions of blocks 902, 904, 906, and 908 are shown performed in parallel, it is understood that in other embodiments, some or all of these actions could be performed serially without departing from the spirit and scope of the invention.

The above specification, examples and data provide a description of the manufacture and use of the composition of the invention. Since many embodiments of the invention can be made without departing from the spirit and scope of the invention, the invention also resides in the claims hereinafter appended.

We claim:

1. A circuit for enabling efficient driving of a plurality of Light Emitting Diodes (LEDs), comprising:

a high side monitoring circuit that is configured to determine a first time to switch between a first gain and a second gain to drive the plurality of LEDs with a plurality of current sources, the LEDs forming multiple parallel branches, each branch including at least one of the LEDs and coupled in series with one of the current sources, the high side monitoring circuit comprising a plurality of first transistors, each first transistor coupled to a different one of the current sources, the first transistors coupled together and configured to generate a voltage representative of a maximum forward voltage across the LEDs, the maximum forward voltage comprising a largest voltage across the LEDs in one of the branches; and a low side monitoring circuit that is configured to determine a second time to switch between the first gain and the second gain to drive the plurality of LEDs with a plurality of current sinks, each branch coupled in series with one of the current sinks, the low side monitoring circuit comprising a plurality of second transistors, each second transistor coupled to a different one of the current sinks, the second transistors coupled together and configured to generate a current representative of the maximum forward voltage.

2. The circuit of claim 1, wherein the low side monitoring circuit comprises:

an output resistance replica generator;

a minimum voltage selector comprising the second transistors;

a maximum LED forward voltage detector and a current mode comparator; and a minimum allowable headroom voltage replica of the current sinks;

wherein the low side monitoring circuit is configured to employ a current mode for determining a gain with which to drive the plurality of LEDs.

3. The circuit of claim 1, wherein the high side monitoring circuit comprises:

a maximum voltage detector comprising the first transistors;

an output resistive replicator; and a voltage headroom replicator;

wherein the high side monitoring circuit is configured to employ a voltage mode to determine a gain with which to drive the plurality of LEDs.

4. The circuit of claim 1, wherein at least one of the high side monitoring circuit and the low side monitoring circuit further comprises a hysteresis generator.

5. The circuit of claim 1, wherein the first gain is different than the second gain.

6. The circuit of Claim 1, further comprising a direct current to direct current (DC-to-DC) converter that enables optimally efficient switching between at least the first gain and the second gain for driving the plurality of LEDs.

7. A circuit for enabling efficient driving of a plurality of Light Emitting Diodes (LEDs), comprising:

a high side monitoring circuit that is configured to determine a first time to switch between a first gain and a second gain to drive the plurality of LEDs with a plurality of current sources, the LEDs forming multiple parallel branches, each branch including at least one of the LEDs and coupled in series with one of the current sources, the high side monitoring circuit comprising a plurality of transistors, each transistor coupled to a different one of the current sources, the transistors coupled together and configured to generate a voltage representative of a maximum forward voltage across the LEDs, the maximum forward voltage comprising a largest voltage across the LEDs in one of the branches; and a low side monitoring circuit that is configured to determine a second time to switch between the first gain and the second gain to drive the plurality of LEDs with a plurality of current sinks.

8. The circuit of claim 7, wherein the high side monitoring circuit comprises:

a maximum voltage detector comprising the transistors;

an output resistance replicator; and a voltage headroom replicator;

wherein the high side monitoring circuit is configured to employ a voltage mode to determine a gain with which to drive the plurality of LEDs.

9. The circuit of claim 7, wherein the circuit further comprises a hysteresis generator.

10. A circuit for enabling efficient driving of a plurality of Light Emitting Diodes (LEDs), comprising:

a high side monitoring circuit that is configured to determine a first time to switch between a first gain and a second gain to drive the plurality of LEDs with a plurality of current sources; and a low side monitoring circuit that is configured to determine a second time to switch between the first gain and the second gain to drive the plurality of LEDs with a plurality of current sinks, the LEDs forming multiple parallel branches, each branch including at least one of the LEDs and coupled in series with one of the current sinks, the low side monitoring circuit comprising a plurality of transistors, each transistor coupled to a different one of the current sinks, the transistors coupled together and configured to generate a current representative of a maximum forward voltage across the LEDs, the maximum forward voltage comprising a largest voltage across the LEDs in one of the branches.

11. The circuit of claim 10, wherein the low side monitoring circuit comprises:

an output resistance replica generator;

a minimum voltage selector comprising the transistors;

a maximum LED forward voltage detector and a current mode comparator; and a minimum allowable head room voltage replica of the current sinks;

wherein the low side monitoring circuit is configured to employ a current mode for determining a gain with which to drive the plurality of LEDs.

12. The circuit of claim 10, wherein the circuit further comprises a hysteresis generator.

13. A circuit for enabling efficient driving of a plurality of Light Emitting Diodes (LEDs) comprising:

a high side monitoring circuit that is configured to determine when to switch between a first gain and a second gain to drive the plurality of LEDs with a plurality of current sources, the LEDs forming multiple parallel branches, each branch including at least one of the LEDs and coupled in series with one of the current sources, the high side monitoring circuit comprising a plurality of first transistors, each first transistor coupled to a different one of the current sources, the first transistors coupled together and configured to generate a voltage representative of a maximum forward voltage across the LEDs, the maximum forward voltage comprising a largest voltage across the LEDs in one of the branches;

a low side monitoring circuit that is configured to determine when to switch between the first gain and the second gain to drive the plurality of LEDs with a plurality of current sinks, each branch coupled in series with one of the current sinks, the low side monitoring circuit comprising a plurality of second transistors, each second transistor coupled to a different one of the current sinks, the second transistors coupled together and configured to generate a current representative of the maximum forward voltage;

wherein when to switch between the first gain and the final second gain is separately determinable for the high side monitoring circuit and the low side monitoring circuit.

14. The circuit of claim 13, wherein the low side monitoring circuit comprises:

an output resistance replica generator;

a minimum voltage selector comprising the second transistors;

a maximum LED forward voltage detector and a current mode comparator; and a minimum allowable head room voltage replica of the current sinks;

wherein the low side monitoring circuit is configured to employ a current mode for determining a gain with which to drive the plurality of LEDs.

15. The circuit of claim 13, wherein the high side monitoring circuit comprises:

a maximum voltage detector comprising the first transistors;

an output resistance replicator; and a voltage headroom replicator;

wherein the high side monitoring circuit is configured to employ a voltage mode to determine a gain with which to drive the plurality of LEDs.

16. The circuit of claim 13, wherein the first gain is different than the second gain, and wherein the first gain is either a higher gain than the second gain or a lower gain than the second gain.

17. The circuit of claim 16, wherein the lower gain enables a higher voltage range for a battery to drive the plurality of LEDs and the higher gain enables a lower voltage range for the battery to drive the plurality of LEDs.

18. The circuit of claim 13, wherein at least one of the high side monitoring circuit and the low side monitoring circuit further comprises a hysteresis generator.

19. A method for efficiently driving a plurality of Light Emitting Diodes (LED), comprising:

determining an output impedance of a charge pump;

determining a maximum forward voltage associated with the LEDs using a high side monitoring circuit, the LEDs forming multiple parallel branches, each branch including at least one of the LEDs, the maximum forward voltage comprising a largest voltage across the LEDs in one of the branches, the high side monitoring circuit comprising a plurality of first transistors, the first transistors coupled together and generating a voltage representative of the maximum forward voltage;

determining a minimum headroom for each of multiple current sources and each of multiple current sinks to drive the LEDs, each first transistor coupled to a different one of the current sources;

modeling load currents to drive the LEDs using a low side monitoring circuit, the low side monitoring circuit comprising a plurality of second transistors, each second transistor coupled to a different one of the current sinks, the second transistors coupled together and generating a current representative of the maximum forward voltage; and employing, at least in part, an input voltage, the charge pump's output impedance, the maximum forward voltage, each minimum headroom for the current sources and sinks, and the LED load currents to determine a switch point for switching between a first gain and a second gain.

20. The method of claim 19, wherein the switch point is adjustable to optimize efficiency for a plurality of different load currents.

21. The method of claim 19, wherein the first gain is different than the second gain, and wherein the first gain is either a higher gain than the second gain or a lower gain than the second gain.

22. The method of claim 21, wherein the lower gain enables a higher voltage range for a battery to drive the plurality of LEDs.

23. The method of claim 21, wherein the higher gain enables a lower voltage range for a battery to drive the plurality of LEDs.

24. The circuit of claim 1, wherein:

each of the first transistors has a collector coupled to receive a supply voltage, a base coupled to an output of one of the current sources, and an emitter coupled to emitters of the other first transistors; and the voltage representative of the maximum forward voltage is generated at the emitters of the first transistors.

25. The circuit of claim 1, wherein:

each of the second transistors has a collector coupled to ground, a base coupled to an input of one of the current sinks, and an emitter coupled to emitters of the other second transistors; and the current representative of the maximum forward voltage is generated at the emitters of the second transistors.

* * * * *